US005634321A

United States Patent [19]

Martin-Cocher et al.

[11] Patent Number: 5,634,321

[45] Date of Patent: Jun. 3, 1997

[54] OPTIMIZED METHOD OF APPLYING AN OUTER WRAPPING, AND OF TRANSPORTING A WRAPPED LOAD

[75] Inventors: Jean-Paul Martin-Cocher, La Motte Servolex; Georges Jaconelli, Aix-les-Bains, both of France

[73] Assignee: Newtec International, Viroflay, France

[21] Appl. No.: 417,097

[22] Filed: Apr. 5, 1995

[30] Foreign Application Priority Data

Apr. 7, 1994 [FR] France ..... 94 04098

[51] Int. Cl.[6] ..... B65B 53/00

[52] U.S. Cl. ..... 53/441

[58] Field of Search ..... 53/399, 441

[56] References Cited

U.S. PATENT DOCUMENTS

| | | | |
|---|---|---|---|
| 3,495,375 | 2/1970 | Burhop et al. | 53/441 X |
| 4,387,548 | 6/1983 | Lancaster et al. | 53/399 |
| 4,503,658 | 3/1985 | Mouser et al. | 53/441 X |
| 4,934,123 | 6/1990 | Salzsauler | 53/441 X |

FOREIGN PATENT DOCUMENTS

| | | |
|---|---|---|
| 246659 | 11/1987 | European Pat. Off. . |
| 466980 | 1/1992 | European Pat. Off. . |
| 2724100 | 12/1977 | Germany . |
| 1581674 | 12/1980 | United Kingdom . |

*Primary Examiner*—Linda Johnson

*Attorney, Agent, or Firm*—Bell, Seltzer, Park & Gibson, P.A.

[57] ABSTRACT

The present invention relates mainly to an optimized method of applying an outer wrapping to a load, in particular a palettized load, and to transporting the load as wrapped by said method.

A method of the invention includes the following steps:

a) determining the forces that the load must be capable of withstanding and the resulting maximum acceptable deformations;

b) selecting a general outer wrapping configuration as a function of the load to be wrapped, the method of transport, of handling, and/or of storage for the load, and also the available wrapping machines; and c) determining the disposition of the film to be implemented using the minimum quantity of film to achieve wrapping having the configuration as determined in step b) and capable of withstanding without dislocation or unacceptable deformation the stresses as determined in step a).

10 Claims, 2 Drawing Sheets

OPTIMIZED METHOD OF APPLYING AN OUTER WRAPPING, AND OF TRANSPORTING A WRAPPED LOAD

The present invention relates mainly to an optimized method of applying an outer wrapping to a load, in particular a palettized load, and to transporting the load as wrapped by said method.

BACKGROUND OF THE INVENTION

A helical wrapping technique that has now been practically abandoned, used to provide for a film to be stratched directly on a palattized load that was itself generally in the form of a rectangular parallelepiped. The film was paid out from a vertical axis reel fitted with a brake. An end of the film was initially fixed to the load and the load was then caused to rotate about a vertical axis. The film was stretched to a desired value by appropriately braking the real.

Unfortunately, since the load was not cylindrical, but generally in the form of a rectangular parallelepiped, the radial distance to be covered by the film varied with angle, so that rotating the load at constant angular speed and applying constant braking force did not ensure that the film was elongated uniformly. In addition, stretchable film is subject to relaxation such that over a period of substantially 48 hours, the resilient return force relaxes by substantially 50%. Thus, with that type of machine, the stretch forces were limited by those that could be withstood by the load, while the elastic return forces that remained to ensure cohesion of the load during handling and transport were substantially smaller. It therefore became necessary to abandon that type of machine in favor of winding machines of a type that includes a prestretching device having a plurality of motor-driven rollers rotating at different peripheral speeds. At the outlet from the rollers of the prestretching device, the film was wound onto the load to be wrapped with little or no mechanical tension, as explained below with reference to FIG. 1.

In patent application No. 92 10254 (published under the number FR 2 695 102), the Applicant describes a method of wrapping a load with a previously-stretched film, the film being put into place only after the film has been allowed time to relax under mechanical tension. As explained below with reference to FIG. 2, that patent application mentions that it is thus possible to obtain increased residual elongation of the film after relaxation, thereby reducing consumption thereof.

As explained below with reference to said FIG. 2, the Applicant has since discovered that subsequent traction applied to a prestretched film which has relaxed under the prestretching mechanical tension, gives rise to elongation that is less than that generated under the same conditions using an identical film whose stretching has been followed by relaxation under a mechanical tension that is significantly less than the prestretching tension.

OBJECTS AND SUMMARY OF THE INVENTION

Consequently, an object of the present invention is to provide an outer wrapping method that is optimized as a function of the stresses that the load can withstand, in such a manner as to minimize the quantity and/or the quality of film that is required for guaranteeing cohesion of the load.

According to the invention, these objects are achieved by a method comprising the following steps:

a) determining the forces that the load must be capable of withstanding and the resulting maximum acceptable deformations;

b) selecting a general outer wrapping configuration as a function of the load to be wrapped, the method of transport, of handling, and/or of storage for the load, and also the available wrapping machines; and c) determining the disposition of the film to be implemented using the minimum quantity of film to achieve wrapping having the configuration as determined in step b) and capable of withstanding without dislocation or unacceptable deformation the stresses as determined in step a).

In particular, the invention provides a method of applying an outer wrapping to a load, in particular a palettized load, the method comprising a step of stretching a stretchable plastics film for outer wrapping, a step of relaxing the film under mechanical tension, and a step of subsequently depositing the stretched film on the load, thereby ensuring cohesion of the load, the method including the following steps:

a) determining the forces that the load must be capable of withstanding and the resulting maximum acceptable deformations;

b) selecting a general outer wrapping configuration as a function of the load to be wrapped, the method of transport, of handling, and/or of storage for the load, and also the available wrapping machines;

c) determining the disposition of the film to be implemented using the minimum quantity of film to achieve wrapping having the configuration as determined in step b) and capable of withstanding without dislocation or unacceptable deformation the stresses as determined in step a); and d) wrapping the load with the film in the disposition determined in step c).

The invention also provides a method wherein the disposition of the film to be implemented as determined in step c) and as implemented in step d) is helical wrapping with a film whose width is substantially less than the height of the load.

The invention also provides a method of transporting a wrapped load, wherein the load has been wrapped by a method according to the invention, and wherein step a) takes account of the normal stresses applied to such a load during the intended transport.

The invention also provides a method of transporting a wrapped load, wherein the load has been wrapped by a method according to the invention, and wherein step a) takes account of the maximum stresses generated in this type of load by this type of transport.

The invention also provides a method, wherein the transport includes a step of road transport by truck.

The invention also provides a method, wherein the transport includes a step of sea transport by ship.

The invention also provides a method, wherein the transport includes a step of air transport by aircraft.

The invention also provides a method, wherein the transport includes a step of rail transport by rail car.

The invention also provides a method, wherein the transport includes a step of transport by handling equipment.

The invention also provides a method, wherein the transport includes a step of transport by lift trucks.

BRIEF DESCRIPTION OF THE DRAWING

The invention will be better understood from the following description and the accompanying drawings given as non-limiting examples, and in which.

MORE DETAILED DESCRIPTION

Figure 1:
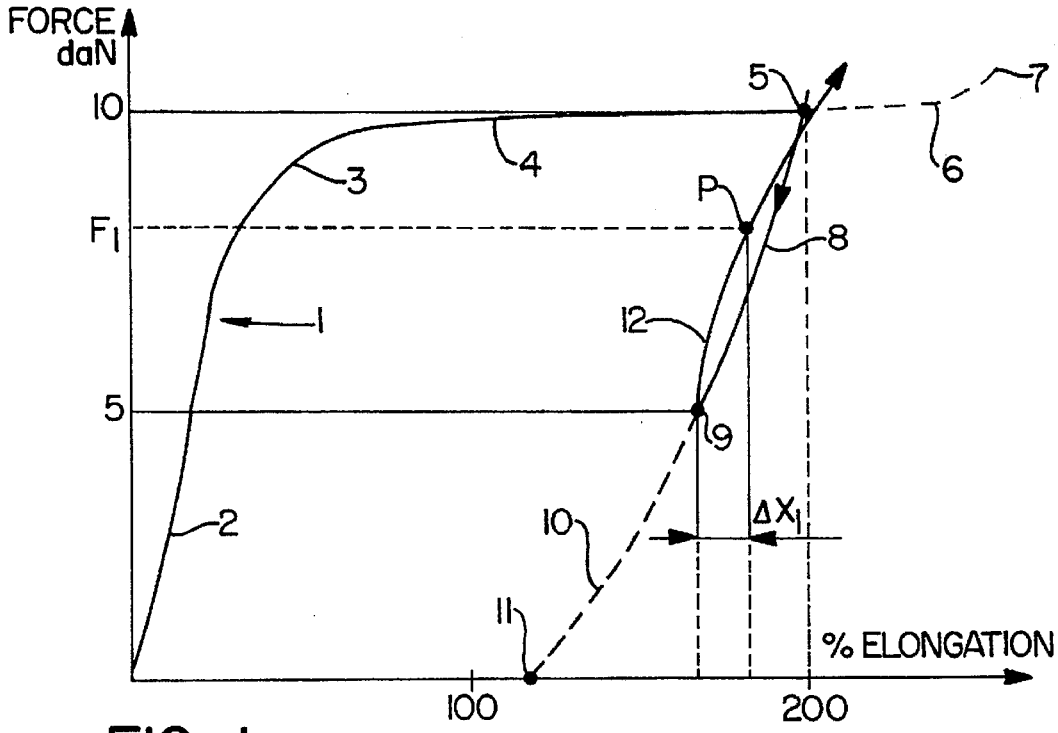
FIG. 1. (PRIOR ART)
FIG. 1 is a curve for explaining the behavior of a prestretched film with relaxation under low stress after it has been placed around a load.

FIG. 1 shows the behavior over time of curve 1 which represents the return force expressed in daN exerted by a stretchable polyethylene film as a function of elongation expressed in percentage during prestretching of known type that is substantially simultaneous with winding around a load. Zero elongation corresponds to the film before stretching, whereas an elongation of 100% corresponds to the length of the film being doubled. Sharp edges of the load are prevented from tearing the film and crushing of the wrapped load is also prevented by relaxing the film during wrapping, but that reduces elongation and therefore increases film consumption. In a conventional wrapping machine, the mechanical tension in the film is reduced by substantially 50% on leaving the prestretched rollers, said reduced mechanical tension being immediately applied to the load during winding. Practically all of the relaxation taking place in film wound around the load with a low level of mechanical tension is equivalent to the residual mechanical tension after relaxation. This tension after release and relaxation corresponds substantially to half the mechanical tension required for obtaining optimum elongation. In the example shown in FIG. 1, simplified curve 1 comprises firstly a substantially linear zone 2 followed by a rounded zone 3 correspond to a plastic flow threshold, and it then approaches the horizontal in a zone 4 which corresponds, for example, to elongation lying in the range 100% to 200% for traction of 10 daN. Traction is stopped at point 5 which corresponds to 10 daN and to elongation of 200%. Additional elongation as represented in dashed lines at 6 would lead to breakage at point 7 corresponding substantially to elongation of 500% and to a force of 15 to 20 daN. In conventional machines, the film is released at 8 and it contracts elastically corresponding to a reduction in the tension and in the elongation until it reaches point 9 which corresponds substantially to a force of 5 daN and to an elongation of 170%. The prestretched film is paid out at a speed slightly greater than that required for wrapping so relaxation takes place under this mechanical tension which is reduced by half mainly in the portion of the film situated between the prestretching device and the load. This reduced return force corresponds to the residual return force after relaxation of the film. This prevents the load that is being wrapped from being subjected to a traction force that is greater than that which will genuinely provide its cohesion during subsequent handling.

At 10, the dashed line shows the relaxation that would take place in the film if the mechanical tension were to be relaxed completely. Under such circumstances, the residual elongation obtained at 11 would be substantially equal to 120%, i.e. the length of the film would have been multiplied by a factor of 2.2.

The Applicant has preformed measurements that are illustrated at 12, relating to applying new traction to the film after relaxing to the point 9. The zone 12 corresponds to stresses applied to the film during manipulation subsequent to the outer wrapping operation, e.g. during handling or transport. For example, if the outer wrapping film is subjected to a force F1 of 10 daN, an additional elongation $\Delta X_1$ of the outer wrapping film is obtained at the point P which corresponds to partial dislocation of the load, where $\Delta X_1$–35%.

Figure 2:
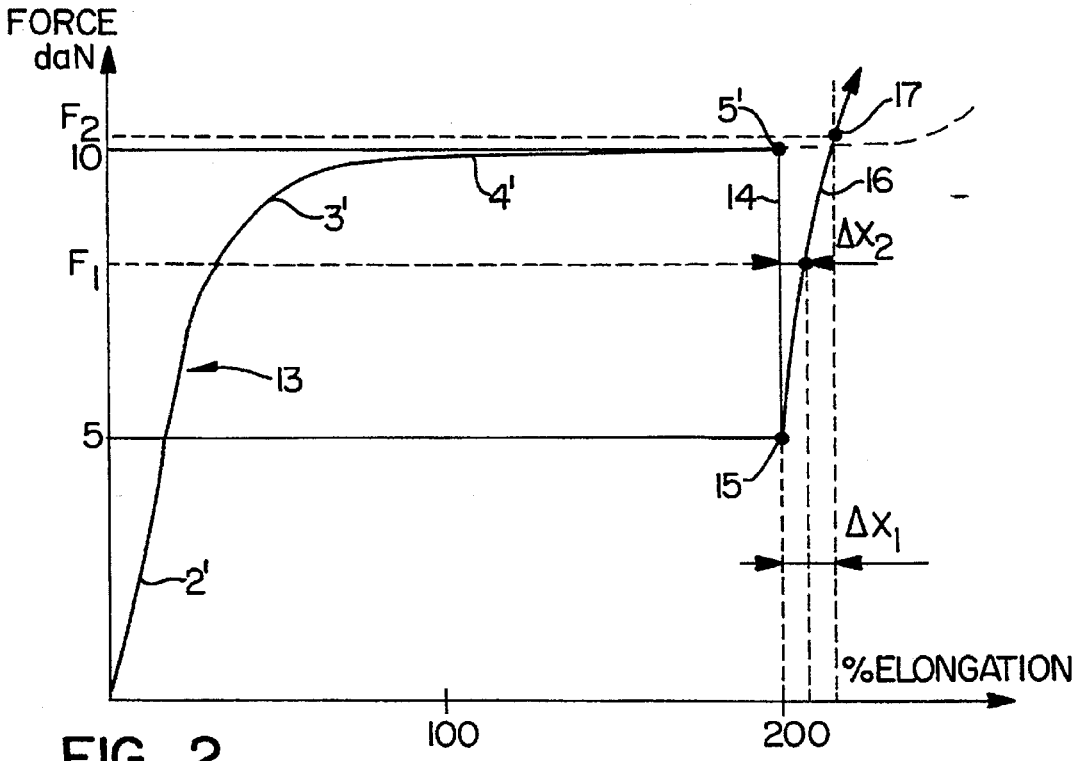
FIG. 2 is a curve for explaining the behavior of a film that has been stretched and allowed to relax under mechanical tension.

As can be seen in FIG. 2, the Applicant has discovered that a load which has been relaxed at substantially the nominal prestretching tension and then subjected to a force F1 equal to the force F1 of FIG. 1, displays an additional elongation $\Delta X_2$ that is substantially equal to half the Additional elongation $\Delta X_1$, or alternatively for an additional elongation equal to $\Delta X_1$, is capable of withstanding at point 17 a force F2 which is substantially equal to 2 F1, and in any case significantly higher than the force F1.

Curve 13 of FIG. 2 has zones 2', 3', 4', and a point 5' equivalent to the zones 2, 3, 4 and the point 5 of FIG. 1, respectively. Thereafter, relaxation corresponding to a vertical drop of the curve 13 is advantageously obtained by maintaining the prestretched film under tension on a mandrel. It is extremely easy to use an ordinary polyethylene stretch film insofar as the film is slightly sticky, thereby avoiding the need to take any special precautions during manipulation. After relaxation 14, the curve reaches point 15 corresponding to a return force of 5 daN, which is half the prestretch force, equal to 10 daN in the example shown, and also corresponding to an elongation of 200%, which is greater than the residual elongation obtained at point 9 of FIG. 1, thus achieving a saving in film already described in patent application No. 92 10254.

In contrast, the present invention is based on the discovery of the behavior of the film in the zone 16 during subsequent stretching, e.g. corresponding to a force exerted by the load on the film, as might occur when the wrapped load is subjected to acceleration during transport. Such acceleration can, for example, be due to sudden turning or braking of the transport means, in particular a truck, or it may be due to a shock received by the load during handling.

The discovery of the behavior under tension greater than the residual tension in the film (5 daN in the example shown) makes it possible, according to the invention, to optimize the outer wrapping and thereby to achieve further savings in film and in time required for wrapping.

Figure 3:
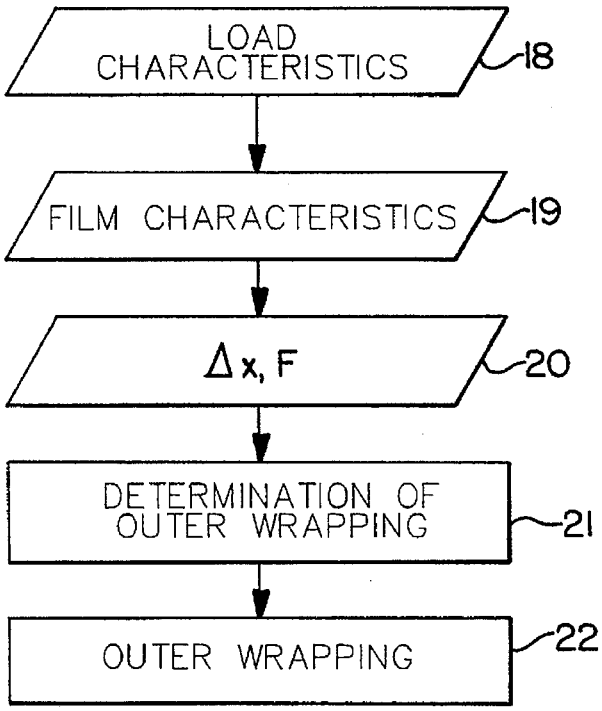
FIG. 3 is a flow chart for explaining the method of the present invention.

FIG. 3 is a flow chart showing an implementation of the method of the invention. The algorithm of FIGS. 3 and 4 may be implemented in a program running on an independent computer, e.g. in the form of an expert system, or it may be programmed in a conventional programming language. Similarly, the computer means may be incorporated in a machine for performing wrapping. Finally, it would not be beyond the ambit of the invention for the calculations to be performed directly by a human operator.

At 18, the characteristics are input of the load to receive the outer wrapping.

The method proceeds to 19.

At 19, the characteristics are input of the stretchable film.

The method proceeds to 20.

At 20, there are input both the value of the maximum additional elongation that the outer wrapping can tolerate and also the force that the outer wrapping must be capable of withstanding. In a variant, these parameters are determined from the characteristics of the load and of the transport and handling that the load must be capable of withstanding without damage. For example, an intelligent outer wrapping machine includes a menu of "result programs" corresponding, for example, to transport by sea, to transport by standard road truck, and to transport by truck in a severe environment.

The method proceeds to 21.

Figure 4:
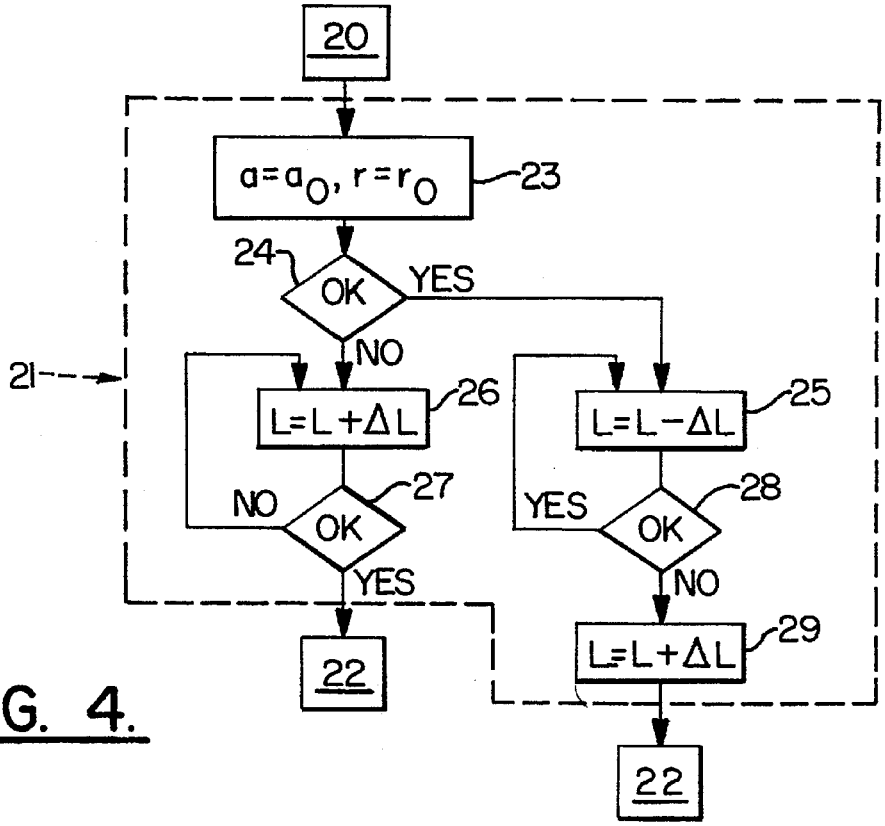
FIG. 4 is a flow chart showing a detail of FIG. 3.

At 21, as explained in greater detail below with reference to FIG. 4, the method determines the characteristics required by the outer wrapping to ensure compliance with the parameters input or determined in step 20.

The method proceeds to 22.

At 22, the load is subjected to outer wrapping in application of the configuration determined at 21.

There follows an explanation of one example of how to determine at 21 the configuration of the outer wrapping.

At 23, the starting values of the outer wrapping are selected. For example, for holical winding, there are selected an angle $\alpha_0$ of the helix relative to the horizontal, and a value $r_0$ of overlap between two successive turns of the film. The initial values correspond advantageously to mean values or to most probable values.

The method proceeds to 24.

At 24, a test is performed to verify that the parameters of the outer wrapping can obtain the performance given or calculated in step 20.

If "yes", the method proceeds to 25.

If "no", the method proceeds to 26.

At 26, the quantity of film to be used is incremented.

The method proceeds to 27.

At 27, a test is performed analogous to the test in step 24.

If "no", the method loops back to 26.

If "yes", step 21 has terminated and the method proceeds to wrapping step 22.

At 25, the quantity of film to be used is decremented by one step.

The method proceeds to 28.

At 28, a test is performed analogous to the test at step 24.

If "yes", the method loops back to 25.

If "no", the method proceeds to 29.

At 29, the quantity of film calculated at step 25 during the last execution but one of the loop including steps 25 and 28 is determined. For example, the increment which has just been subtracted at step 25 is added back to the quantity of film.

When step 21 is terminated, the method proceeds with wrapping step 22.

The present invention may implement prior stretching devices for film as described in patent application No. 92 10254. Under such circumstances, by way of example, the film is subjected to prior stretching and is stored under mechanical tension on reels that are used only once the desired relaxation level has been reached. Under such circumstances, the outer wrapping machines are not provided with stretching means, thereby reducing the complexity and the price thereof while increasing their performance, and in particular increasing the speed at which outer wrapping can be performed because of the reduction in weight of the moving parts, since they no longer include any prestretching rollers. This is particularly advantageous for machines in which the load remains stationary and in which the reels move round on a ring. It is also possible to implement machines in which the helical winding is provided by rotating the load.

Machines can also be implemented that serve substantially simultaneously to stretch the film and to apply said film at a tension substantially equal to the prestretch tension to the load as an outer wrapping. Clearly it is necessary for the load that is to be wrapped to be capable of withstanding such mechanical tension. In addition, optimum use of the film is not possible when the load is substantially in the form of a rectangular parallelepiped unless means are provided for ensuring that the tension in the film remains substantially constant independently of the angle at which the load is presented relative to the film. Such constant tension can be obtained, for example, by synchronizing rotation of the load relative to the axis of the reel of film while the film is being paid out. When the length to be covered is longer, particularly at the edges of the load, then the synchronization device provides a greater quantity of film. Otherwise, over the plane faces, the synchronization device provides a smaller quantity of film.

For example, a tachometer detector may be used which is rotated by the constant speed of rotation of the film in the immediate vicinity of the load by quasi-instantaneous servocontrol of the drive applied to the machine for performing outer wrapping.

The invention is applicable mainly to applying outer wrapping to palettized loads, in particular by winding.

We claim:

1. A method of applying an outer wrapping to a load comprising the steps of:

a) determining the forces that the load must be capable of withstanding and a maximum amount of deformation of the load which is permitted;

b) selecting a general outer wrapping configuration;

c) determining a disposition of the outer wrapping using a minimum quantity thereof so that the load is wrapped according to step (b) and is capable of withstanding the forces determined in step (a);

d) prestretching a stretchable plastic film to a predetermined elongation to be used as said outer wrapper;

e) relaxing the film under mechanical tension while maintaining said predetermined elongation; and f) wrapping the load with said prestretched film in the disposition of step (c).

2. A method according to claim 1, wherein the disposition of the film to be implemented as determined in step c) and as implemented in step d) is helical wrapping with a film whose width is substantially less than the height of the load.

3. A method according to claim 1 wherein step a) includes calculation of normal stresses applied to the load during a selected mode of transport.

4. A method according to claim 1 wherein step a) including calculation of maximum stresses generated in said load by a selected mode of transport.

5. A method according to claim 3, further including the step of transporting said load by said selected mode of transport wherein said mode of transport is road transport by truck.

6. A method according to claim 3, further including the step of transporting said load by said selected mode of transport wherein said mode of transport is sea transport by ship.

7. A method according to claim 3, further including the step of transporting said load by said selected mode of transport wherein said mode of transport is air transport by aircraft.

8. A method according to claim 3, further including the step of transporting said load by said selected mode of transport wherein said mode of transport is rail transport by rail car.

9. A method according to claim 3, further including the step of transporting said load by said selected mode of transport wherein said mode of transport is by handling equipment.

10. A method according to claim 9, further including the step of transporting said load by said selected mode of transport wherein said mode of transport is by lift trucks.

* * * * *